United States Patent [19]

Lewis et al.

[11] Patent Number: 4,468,912

[45] Date of Patent: Sep. 4, 1984

[54] APPARATUS FOR DEPOSITING COUPONS ON CARTONS

[75] Inventors: Robert T. Lewis; Everett N. Finn, both of Louisville, Ky.

[73] Assignee: Brown & Williamson Tobacco Corporation, Louisville, Ky.

[21] Appl. No.: 322,058

[22] Filed: Nov. 16, 1981

[51] Int. Cl.[3] ..... B65B 61/20

[52] U.S. Cl. ..... 53/137; 156/521; 156/566; 493/76; 493/344; 493/379

[58] Field of Search ..... 53/137, 209; 156/521, 156/DIG. 33, 566; 493/344, 75, 76, 77, 78, 84, 379

[56] References Cited

U.S. PATENT DOCUMENTS

| | | | |
|---|---|---|---|
| 894,959 | 8/1908 | Kingsbury | 493/76 |
| 1,247,364 | 11/1917 | Bracy | 53/157 |
| 2,006,215 | 6/1935 | Kassekert | 493/344 |
| 2,687,819 | 8/1959 | Hill | 156/521 |
| 4,299,073 | 11/1981 | Goricz | 53/209 |
| 4,343,129 | 8/1982 | Gunther | 53/209 |

FOREIGN PATENT DOCUMENTS

| | | | |
|---|---|---|---|
| 379734 | 9/1932 | United Kingdom | 156/DIG. 33 |
| 879690 | 10/1961 | United Kingdom | 156/DIG. 33 |

*Primary Examiner*—John Sipos
*Attorney, Agent, or Firm*—Charles G. Lamb

[57] ABSTRACT

An apparatus for placing coupons, and the like, on cartons includes a supply source of coupons in the form of a web of coupons, a coupon advance drum for moving the coupon web from the supply source to the location of the cartons upon which the coupons are to be deposited, a knife device for cutting the coupons to be deposited from the coupon web, a movable coupon applying device which receives coupons at the knife device as they are cut from the coupon web and moves the coupons to a position above the cartons, and moving means for contemporaneously moving the carton and the coupon away from the applying means so that the coupon is moved out of the applying means and onto the carton as the carton and coupon are being moved.

7 Claims, 5 Drawing Figures

APPARATUS FOR DEPOSITING COUPONS ON CARTONS

BACKGROUND OF THE INVENTION (1) Field of the Invention

The present invention relates to packaging devices, and more particularly to an apparatus for depositing coupons, and the like on a carton.

(2) Discussion of the Prior Art

The terms coupons and cartons used herein are to be understood in their generic sense. That is, coupon could be certificates, stamps, labels and the like, and cartons could be packages, boxes, containers, bundles and the like.

Coupons are used on cartons in many industries. They are used, for example, to identify the contents of a carton, the condition of the contents of a carton, the destination of a carton, and instructions for the use or assembly of the contents of a carton.

In high production operations, the placing of a coupon on a carton can be time consuming and slow up the entire manufacturing process. Furthermore, the placing of a coupon on a carton is often done manually, which not only contributes to slowing up a high volume production process, but is also a waste of expensive manpower. Quality control is also adversely affected by manually placing coupons on a package because it is obviously a tedious task and one's attention is, therefore, easily diverted.

The problem, briefly stated, is to rapidly place coupons on cartons in a high volume manufacturing operation so as not to slow the maufacturing process, and accomplish this task while making sure that the proper number of coupons are placed in the proper location and orientation on each carton with a minimum of human supervision.

SUMMARY OF THE INVENTION

The present invention provides an apparatus for depositing coupons on a carton in a high volume manufacturing environment which solves these problems.

More particularly, the present invention provides an apparatus for depositing coupons on cartons comprising a supply source of a web of coupons, a rotatably mounted coupon web advance drum to engage the coupon web in overlaying relationship around at least a portion of its periphery for pulling the coupon web from its source and moving the coupon web to the location of a carton upon which coupons are to be deposited, coupon web stripping means for separating the coupon web from the periphery of the coupon web advance drum, knife means near the location of the carton upon which coupons are to be deposited, coupon applying means for receiving coupons at the knife means as they are cut from the coupon web and depositing the coupons on a carton, and means for moving the carton away from the applying means after coupons have been deposited thereon.

BRIEF DESCRIPTION OF THE DRAWINGS

A better understanding of the present invention can be had upon reference to the accompanying specification and the following drawings in which.

DETAILED DESCRIPTION OF THE PREFERRED EMBODIMENT

The figures illustrate an apparatus, generally denoted as the numeral 10, for depositing coupons 12, and the like, onto a surface of, for example, a carton 14.

Figure 2:
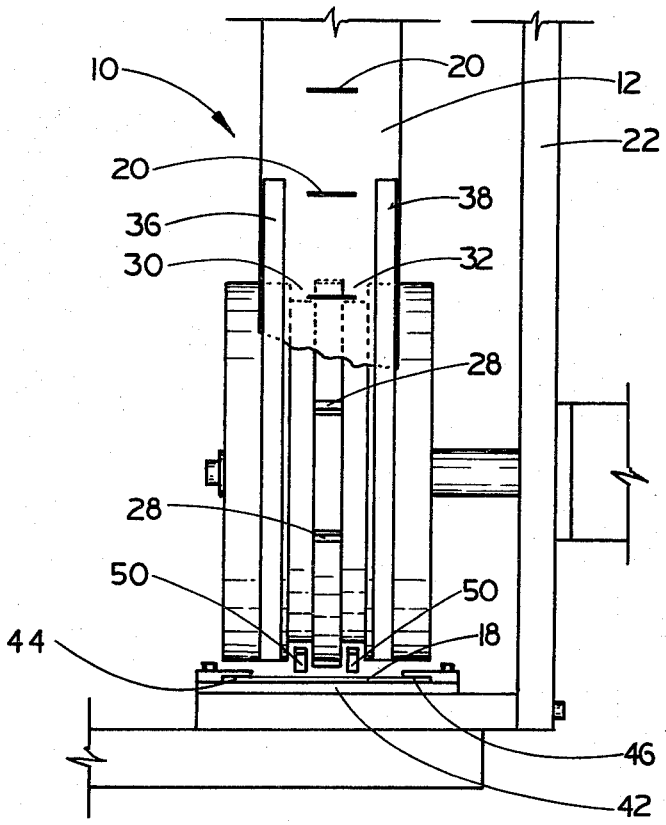
FIG. 2 is a view taken along the line 2—2 in FIG. 1.

The coupons 12 to be deposited on the carton 14 are supplied from a roll of coupons 16. The roll of coupons 16 is formed of a web 18 having a plurality of coupons 12. The web 18 can be, for example, a continuous length of paper material having individual coupons printed thereon. As can be seen in FIG. 2, the web is formed with a plurality of spaced apart, parallel slits 20 oriented transversely of and centered on the longitudinal center line of the web 18. As illustrated, each slit 20 is formed through a different one of the coupons 12 as opposed, for example, to being formed at the margin of a coupon.

The coupon depositing apparatus 10 as an appropriate frame, generally denoted as the numeral 22, to which its various components are mounted. However, the frame 22 is not particularized for the reason that it is incidental to the present invention.

Figure 1:
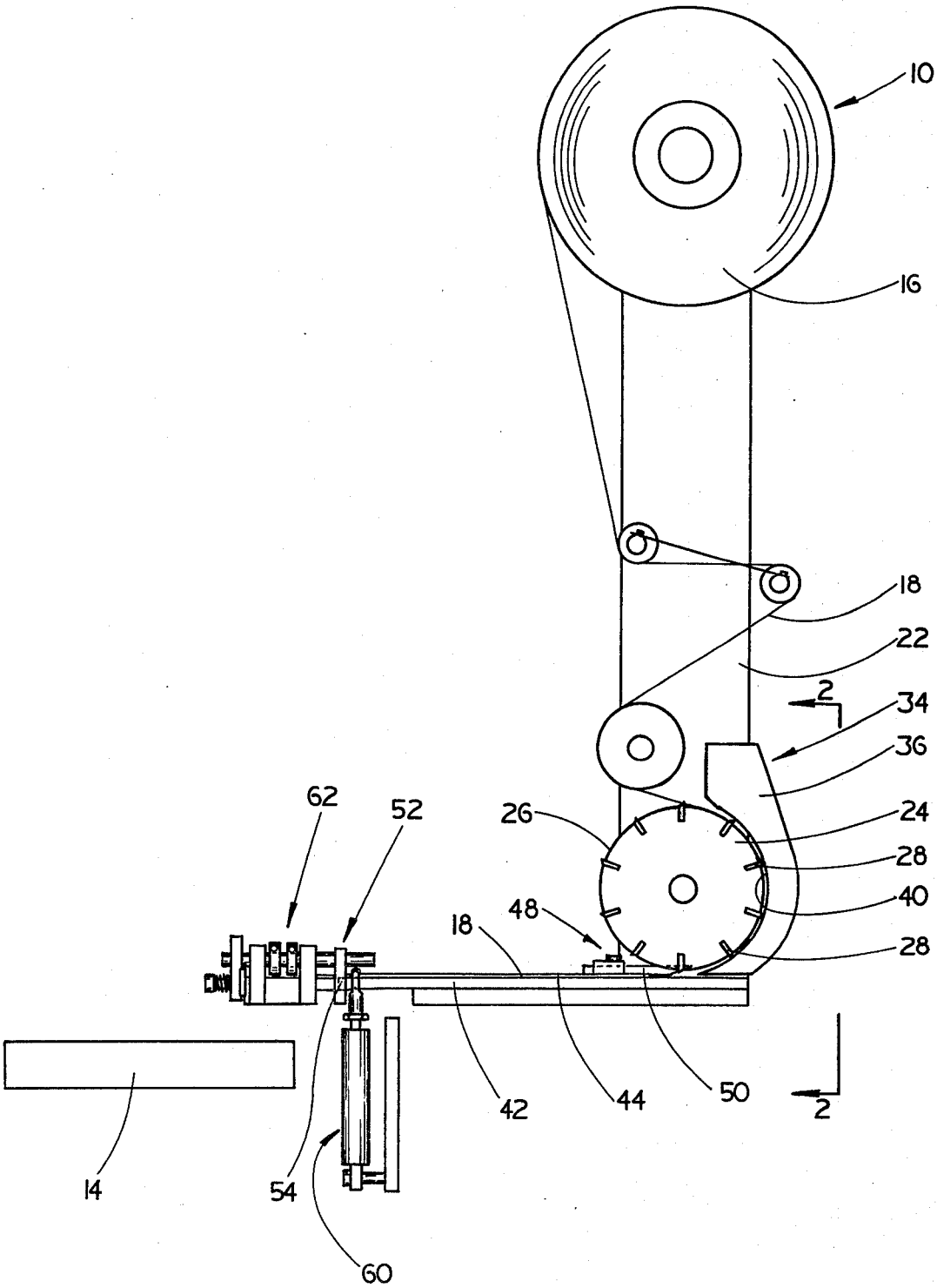
FIG. 1 is a side view of an advantageous embodiment of the present invention.

With reference to FIGS. 1 and 2, a web advance drum 24 is rotatably mounted to the frame 22 near the supply roll 16. The web advance drum 24 has a peripheral surface 26 of substantially the same width as the width of the coupon web 18. A plurality of web engagement cleats 28 are equally spaced about the periphery of the web advance drum 24 and project radially outwardly from the periphery of the drum 24. The web engagement cleats 28 are about as long as the length of the slits 20 and are centered on the peripheral surface 26 of the drum 24, but do not extend across the full width of the peripheral surface of the drum. These web engagement cleats 28 are each received through a different one of the slits 20 in the coupon web 18 so that, as the web advance drum rotates, the cleats 28 coact with the slits 20 and pull the coupon web 18 from the supply roll 16. The web advance drum 24 is also formed with two circumferential grooves 30 and 32 in its peripheral surface 26 on either side of the cleats 28 for a reason hereinafter explained. The web advance drum 24 is driven by usually any conventional, or otherwise convenient means so that it does not continuously rotate, but instead indexes through arcuate distances corresponding to the distance between adjacent cleats 28, if a single coupon is to be deposited on the carton 14, or through a multiple of the distance between adjacent cleats 28 if more than one coupon is to be deposited on a carton.

Web hold down means, generally denoted as the numeral 34, is provided at the peripheral surface 26 of the web advance drum 24 to assure that the coupon web 18 does not prematurely separate from the web advance drum 24. The web hold down means 34 is illustrated in FIGS. 1 and 2, as comprising two web hold down plates 36 and 38 each located next to a different one of the circumferential grooves 30 and 32. Each of the hold down plates 36 and 38 has a concave arcuate surface 40 of substantially the same radius as the web advance drum 24. The hold down plates 36 and 38 are each coaxially disposed with the advance drum with the arcuate surface 40 circumscribing about 180° of the periphery of the advance drum 24. The arcuate surface 40 of each plate is spaced from the peripheral surface 26 of the advance drum 24 by an amount about the same as the thickness of the coupon web 18. The coupon web 18 extends from the supply roll 16 and overlays the peripheral surface 26 of the advance drum 24 covered by the arcuate surfaces 40 of the hold down plates 36 and 38 with the longitudinal edges of the coupon web in the space between the peripheral surface of the drum and the arcuate surfaces of the hold down plates.

A horizontally disposed, elongated coupon web slide plate 42 extends substantially tangentially from the peripheral surface 26 of the advance drum 24 to the location of a carton upon which coupons are to be deposited. The opposite longitudinal edges of the coupon web slide plate 42 define facing open channels 44 and 46, each receiving a different longitudinal side of the coupon web to cage the coupon web therebetween, and guide the coupon web along the elongated slide plate 42 as the coupon web moves longitudinally from the web advance drum to the location of the carton upon which coupons are to be deposited.

Coupon web stripper means, generally denoted as the numeral 48, is located near the juncture of the coupon slide plate 42 and peripheral surface 26 of the web advance drum 24. As shown in FIGS. 1 and 2, the stripper means 48 comprises two spaced apart, generally parallel, stationary fingers 50. Each finger 50 extends, from a fixed end, generally parallel to the web slide plate 42 and projects into a different one of the circumferential grooves 30 and 32. Each finger 50 is spaced above the surface of the web slide plate 42 by a distance about the thickness of the coupon web. As the coupon web on the peripheral surface 26 of the advance drum 24 reaches the coupon web stripper means 48, the free ends of the fingers 50 in the circumferential grooves 30 and 32 lift the coupon web from the peripheral surface of the drum stripping the coupon web from the engagement cleats 28, and guides the coupon web onto the web slide plate 42 and the opposite longitudinal edges of the coupon web into opposite, facing open channels 44 and 46 along the longitudinal edges of the web slide plate 42. The coupon web is pushed by the indexing web advance drum from the advance drum longitudinally along the web slide plate 42 toward the location of the carton upon which the coupons are to be deposited.

Figure 5:
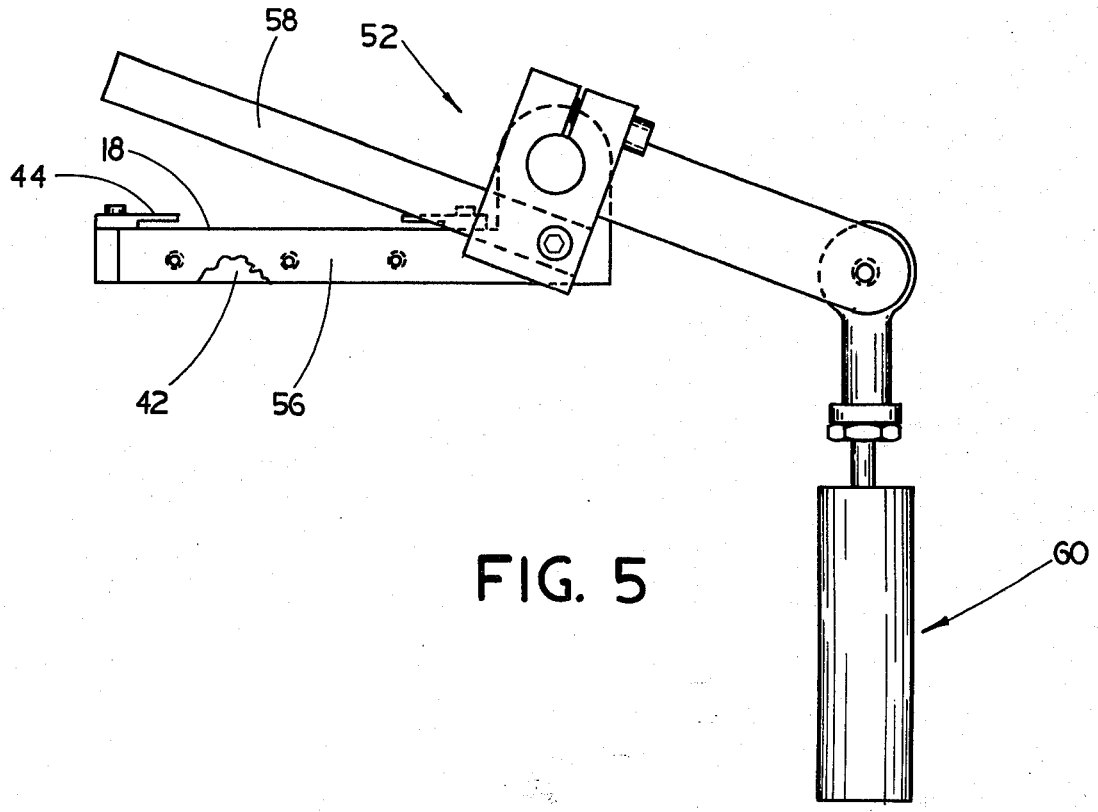
Figure 4:
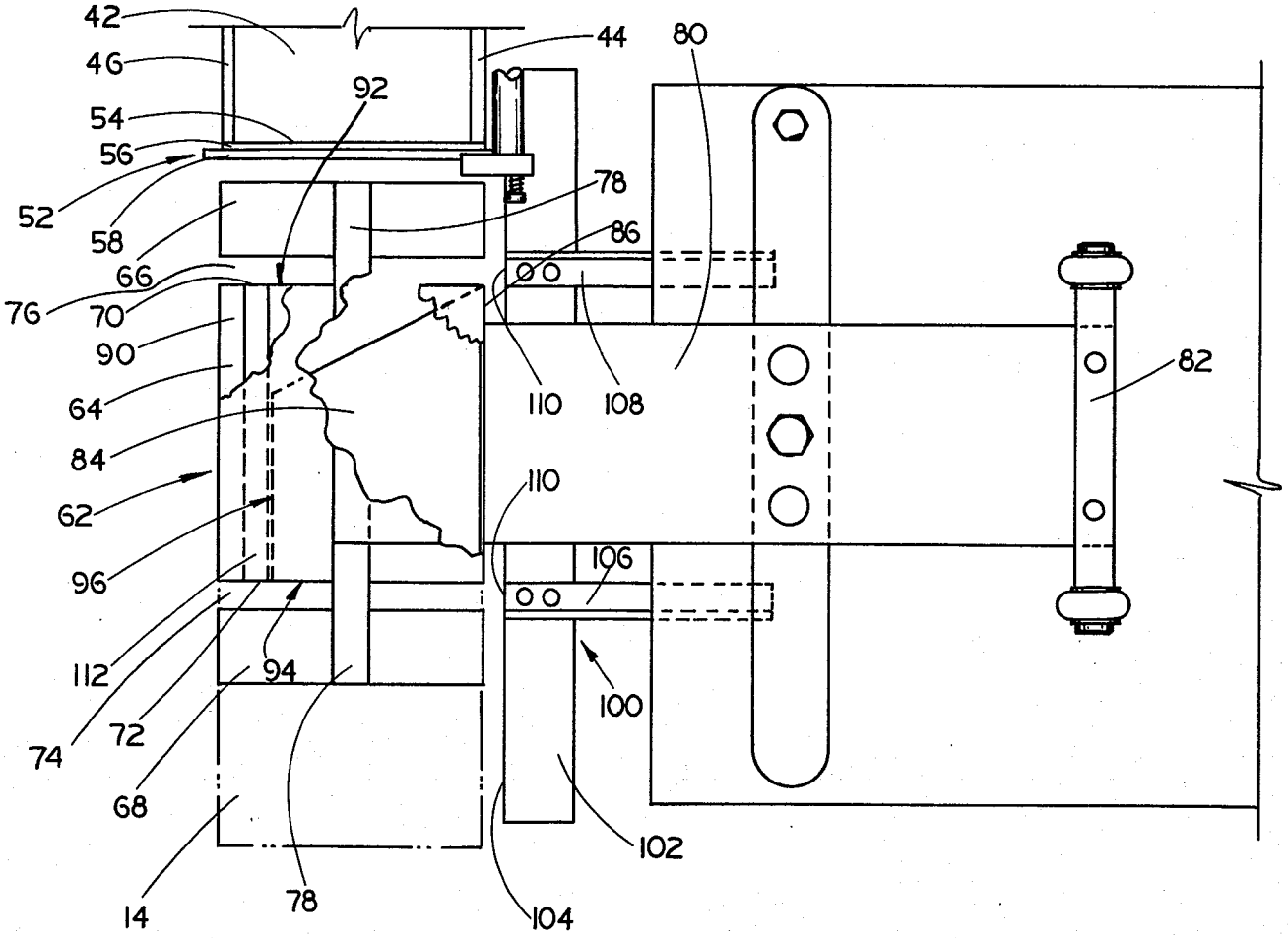
FIG. 4 is a plan view of the component of FIG. 3 as viewed along the line 4—4 in FIG. 3; and, FIG. 5 is an enlarged view of another component of the present invention.

With reference to FIGS. 1, 4 and 5, web cutting means, generally denoted as the numeral 52, is positioned at the end 54 of the coupon slide plate 42 opposite that end of the slide plate at the advance drum 24. The end 54 of the slide plate 42 is adjacent the location of the carton upon which coupons are to be deposited. The web cutting means 52 cuts the coupon web into individual coupons, or selected multiples of coupons for deposits onto the carton. The web cutting means 52 is illustrated as comprising a stationary blade 56 attached to the end 54 of the web slide plate 42 and a pivotally mounted movable blade 58 which coacts with the stationary blade 56 in a scissors-like manner to cut the coupon web as it moves on the web slide plate between the fixed and movable blades. The movable blade 58 can be moved by virtually any conventional, or otherwise convenient means such as, for example, a pneumatic cylinder and piston assembly 60 which has its piston rod attached to the movable blade 58. The movable blade 58 is operated in a timed sequence with the indexing of the web advance drum 24 such that, when the web advance drum 24 comes to rest with a portion of the coupon web positioned between the fixed and movable blades, the movable blade 58 is pivoted to its coacting position with the fixed blade 56 cutting a coupon, or a strip of coupons, from the coupon web. And, just as the advance drum 24 begins to index again, feeding another length of the coupon web along the slide plate 42 toward the cutting means, the movable blade 58 is pivoted away from the fixed blade 56 so that a length of the coupon web can be fed between the fixed blade 56 and movable blade 58.

Figure 3:
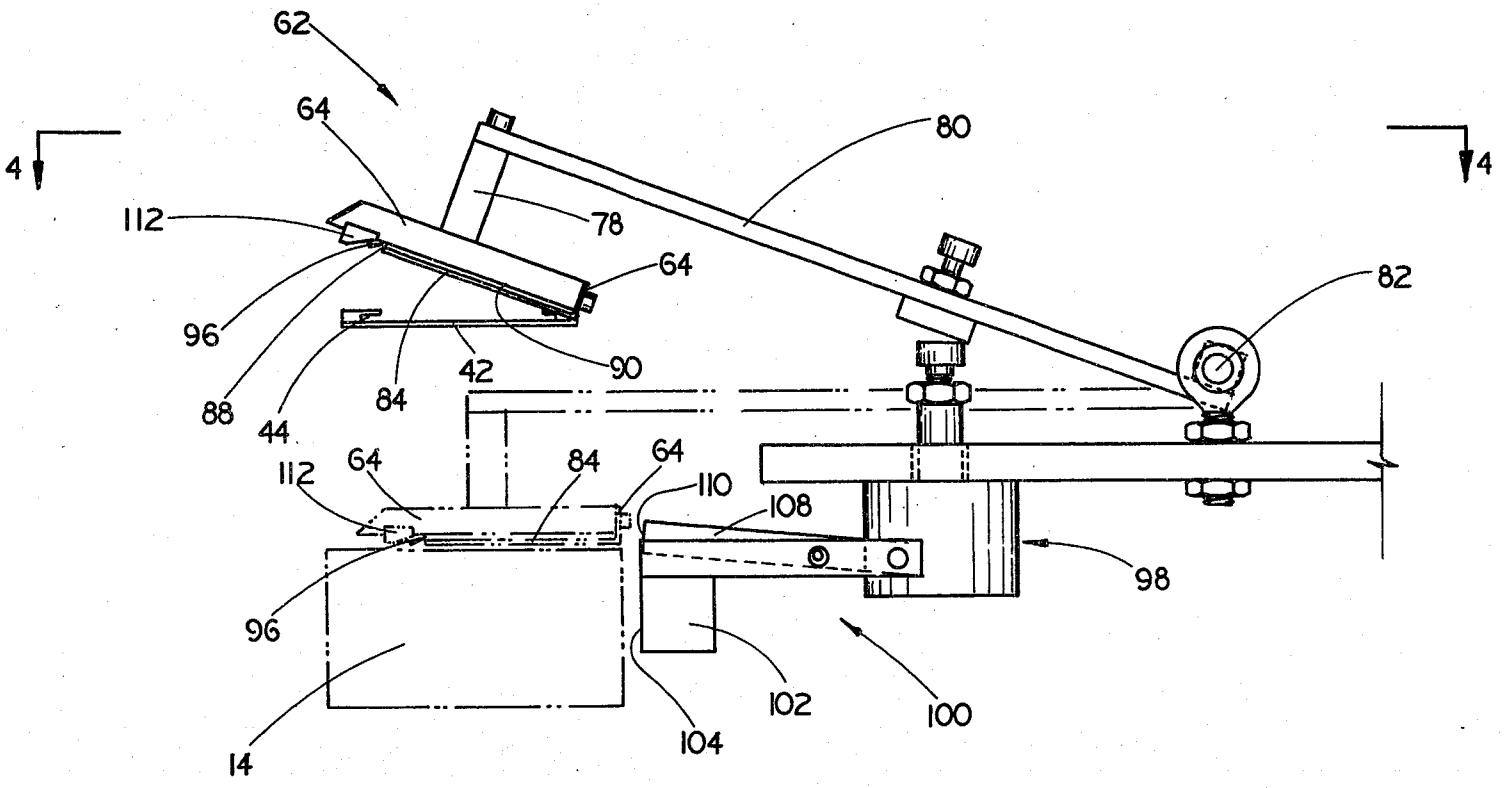
FIG. 3 is an enlarged view of a component of the present invention taken along the line 3—3 in FIG. 1.

As can be best seen in FIGS. 1, 3 and 4, coupon applying means, generally denoted as the numeral 62, is located near the end 54 of the web slide plate 42 next to the web cutting means 52, and generally over the carton 14 upon which the coupons are to be deposited. The coupon applying means 62 is mounted for movement between a first or upper position (shown in solid lines in FIG. 3) for receiving a length of the coupon web moving past the end 54 of the slide plate between the fixed and movable blades of the cutting means, and a second or lower position (shown in broken lines in FIG. 3) for depositing the coupons cut from the coupon web onto the cartons. The coupon applying means 62 is shown as comprising a carton plate 64 and two end plates 66 and 68. The center plate and end plates are coplanar with the end plates 66 and 68 being spaced apart from the opposite ends 70 and 72, respectively, of the center plate 64 to define two parallel slots 74 and 76. The overall length of the coupon applying means 62 is approximately equal to the length of the coupon, or multiple coupons, to be deposited on the carton 14. The three plates 64, 66 and 68 are attached together by a bar 78 extending lengthwise across their top surfaces and attached thereto by means of, for example, bolts. A pivot arm 80 is attached at one of its ends to the bar 78 and is pivotally mounted at its opposite end 82 to the frame 22. A flange 84 is attached to one longitudinal side 86 of the center plate 64 and extends therefrom in a cantilevered manner, and in overlaying, parellel, spaced apart relationship to the bottom surface 88 of the center plate toward the opposite longitudinal side of the center plate. The space between the flange 84 and the bottom surface 88 of the center plate 64 is approximately the same as the thickness of the coupon web, and constitutes a coupon receiving slot 90. Thus, both ends 92 and 94 of the coupon receiving slot 90, that is the ends adjacent each of the end plates 66 and 68, are open, and one side 96 of the coupon receiving slot 90 along one longitudinal side of the center plate 64 is open. The coupon applying means 62 is located with one end plate 66 near the end 54 of the slide plate 42 adjacent the coupon cutting means 52. When the coupon applying means is in the upper position, the coupon receiving slot 90 is located to receive the length of coupon web projecting past the end 54 of the slide plate 42 between the fixed and movable blades of the cutting means. However, as can be seen in FIG. 3, when the coupon applying means 62 is in the upper position, the coupon receiving slot 90 is not coextensive with the slide plate 42, but is disposed at an angle to it. To insure that the length of coupon web being moved past the end 54 of the slide plate through the cutting means is fed into the coupon receiving slot 90, the end of the flange 84 adjacent the end 54 of the slide plate 42 is angled away from the end 54 of the slide plate 42. When the coupon applying means 62 is in the upper coupon web receiving position, the portion of the coupon receiving slot 90 at the apex of the angled end of the flange 84 is in-line with the slide plate 42. Thus, a length of coupon web moving past the end 54 of the slide plate 42 is received first in this position of the coupon receiving slot and is guided by the angled edge of the flange all the way into the coupon receiving slot 90. Because the coupon in the coupon receiving slot 90 is about as long as the entire length of the coupon applying means, the coupon will extend from each open end 92 and 94 of the coupon receiving slot 90, and past each of the parallel slots 74 and 76 between the end plates 66 and 68, respectively, and the center plate 64. The coupon applying means is caused to move between its upper and lower positions about the pivoted end 82 of the pivot arm 80 by means of, for example, a pneumatic cylinder and piston device 98 which has its piston rod in operative communication with the pivot arm 80. When the piston rod moves into the cylinder, the pivot arm is moved downwardly, moving the coupon applying means to its lower, or coupon depositing position. When the piston rod moves out off the cylinder, the pivot arm is moved upwardly, moving the coupon applying means to its upper, or coupon web receiving position. The coupon applying means is moved in timed sequence with the cutting means such that the coupon applying means is in the upper, or coupon receiving position, when the fixed and movable blades of the cutting means are separated and the advance drum is indexing to move a length of coupon web through the cutting means and into the receiving slot 90 of the coupon applying means. After the coupon advance drum has stopped, and the movable blade of the coupon cutting means has been actuated, cutting a coupon from the coupon web, the coupon applying means is moved to its lower, or coupon depositing position, locating the coupon in the coupon receiving slot over the top surface of the carton.

Carton moving means, generally denoted as the numeral 100, is located adjacent the carton with the coupon located on its top surface away from the carton applying means 62 in a direction about 90° to the longitudinal axis of the coupon slide plate 42. The carton moving means 100 is shown best in FIGS. 3 and 4 as comprising a carton pusher bar 102 with a carton contact surface 104, and two spaced apart upwardly extending levers 106 and 108 each having a coupon contact surface 110. The levers 106 and 108 are spaced apart by a distance coinciding to the distance separating the two spaced apart parallel slots 74 and 76 between the end plates and center plate of the coupon applying means. When the carton moving means 100 moves is in a direction 90° to the slide plate 42 and beneath the carton applying means 62, the carton contact surface 104 of the carton pusher bar 102 contacts the facing wall of the carton, and the coupon contact surfaces 110 of the levers 106 and 108 contact the edge of the coupon in the parallel slots 74 and 76 defined between the end plates and center plate of the coupon applying means. As the carton moving means continues to move, pushing the carton away from the coupon applying means, the pusher bar 102 moves beneath and past the applying means 62 and the levers 106 and 108 move through the parallel slots 74 and 76, respectively. It is desirable to have the contact surfaces 110 of the levers 106 and 108 make contact with the edge of the coupon in the coupon receiving slot 90 contemporaneously with the contact surface 104 of the pusher bar 102 contacting the carton. Thus, the coupon is pushed from the coupon receiving slot through the open side 96 of the receiving slot at the same time the carton is moved from beneath the coupon applying means. To further assure that the coupon will remain in a correct position on the carton, a drag bar 112 is attached to the bottom surface 88 of the center plate 64 of the coupon applying means 62. The drag bar 112 is spaced from and generally parallel to the open side 96 of the coupon receiving slot 90, and depends slightly below the flange 84 defining the bottom surface of the coupon receiving slot 90. As the coupon and carton move beneath the applying means 62, the drag bar 112 rests on the coupon as it emerges through the open side 96 of the coupon receiving slot 90, pushing the coupon adjacent the top surface of the carton so that the carton and coupon are uniformly accelerated away from the applying means.

The carton moving means 100 can be caused to move by virtually any conventional, or otherwise convenient means, such as a pneumatic piston and cylinder device (not shown) which is horizontally disposed with its piston rod operatively attached to the pusher bar 102.

The carton moving means is operated in timed sequence with the movement of the coupon applying means 62 such that after the coupon applying means 62 has moved to its lower or second position, the carton moving means is actuated to move the carton and coupon away from the coupon applying means.

As illustrated, the coupon contact levers 106 and 108 of the carton moving means 100 are pivotally mounted from movement between an extended position to contact the edge of a coupon in the coupon receiving slot 90 and a retracted position wherein they do not extend above the carton pusher bar 102. This feature is necessary to accomplish the downstream operation of moving the cartons 14 into a container. The levers 106 and 108 are retracted so that they will not interfere with this downstream operation.

The foregoing detailed description is given primarily for clarity of understanding and no unnecessary limitations should be understood therefrom for modifications will be obvious to those skilled in the art upon reading this disclosure and may be made without departing from the spirit of the invention or the scope of the appended claims.

What is claimed is:

1. An apparatus for depositing coupons, and the like, onto a carton, comprising:

a supply source of a web of coupons;

a rotatably mounted coupon web advance drum adapted to engage the coupon web in overlaying relationship around at least a portion of its periphery;

a coupon web slide plate extending from said advance drum;

coupon web stripper means for stripping said coupon web from said advance drum and guiding said coupon web onto said coupon web slide plate;

coupon web cutting means located near the end of said slide plate opposite said advance drum for cutting coupons from said coupon web;

coupon applying means located near said cutting means for receiving coupons from said cutting means and depositing the coupons adjacent the surface of a stationary carton disposed beneath said coupon applying means, said coupon applying means comprises means defining a coupon receiving slot for receiving coupons from said cutting means, said coupon receiving slot is open at both longitudinal ends in the direction of infeed of said coupons and at one side, means for moving said coupon applying means between a first position for receiving a coupon from said cutting means and a second position for depositing the received coupon onto the stationary carton, said second position being spaced above said carton; and carton moving means for contemporaneously moving the carton and coupon away from said coupon applying means by moving the carton from beneath said coupon applying means and by moving the coupon from said coupon receiving slot through the open side of said coupon receiving slot onto the carton as the carton and coupon are moved by said moving means and having means for engaging said coupon and carton for moving the coupon out of said applying means in its second position.

2. The apparatus of claim 1, wherein said coupon web slide plate comprises opposite longitudinal sides formed with facing channels for engaging opposite longitudinal sides of said coupon web and guiding said web longitudinally along said slide plate.

3. The apparatus of claim 1, said web advance drum is rotatably driven to periodically index through an arc corresponding to the length of a predetermined number of coupons.

4. The apparatus of claim 3, wherein said coupon cutting means operates in timed sequence with the indexed rotation of said advance drum whereby said cutting means is actuated to cut coupons from said coupon web after said advance drum has momentarily stopped indexing having moved the predetermined number of coupons thereon along said slide plate and into position at said cutting means.

5. The apparatus of claim 1, wherein said coupon applying means comprises a coupon drag bar depending past the open side of said coupon receiving slot for exerting a drag force on the coupon and forcing it against the carton as the coupon is moved from said coupon receiving slot and onto the carton.

6. The apparatus of claim 1, wherein said carton moving means comprises a carton contact surface and a coupon contact surface constructed so that said carton contact surface contacts the carton contemporaneously with said coupon contact surface contacting said coupon when said coupon applying means is in said second position.

7. The apparatus of claim 1, means for moving said coupon applying means being in timed sequence with said cutting means such that said coupon applying means moves from said first position to said second position after said cutting means is activated for cutting coupons from the web.

* * * * *